US006032801A

United States Patent [19]

Jupille et al.

[11] Patent Number: 6,032,801

[45] **Date of Patent: *Mar. 7, 2000**

[54] PALLET SYSTEM

[75] Inventors: Henry Jupille, Placerville; David James Tostenson, Auburn, both of Calif.

[73] Assignee: Jupille Design Incorporated, Placerville, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,399

[22] Filed: Jan. 17, 1997

[51] Int. Cl.[7] ..... B65D 19/18

[52] U.S. Cl. ..... 206/597; 108/55.3; 206/386; 206/451; 206/499

[58] Field of Search ..... 108/52.1, 53.3, 108/55.1, 55.3, 55.5, 56.1, 57.29, 57.3; 206/386, 451, 499, 504, 585, 595–600, 821; 248/346.01, 346.02; 428/163, 167

[56] References Cited

U.S. PATENT DOCUMENTS

| | | | |
|---|---|---|---|
| 3,120,825 | 2/1964 | Johnson . | |
| 3,229,836 | 1/1966 | Koenig . | |
| 3,418,792 | 12/1968 | Quintilian et al. | 206/499 |
| 3,720,176 | 3/1973 | Munroe . | |
| 4,226,192 | 10/1980 | Myers . | |
| 4,416,385 | 11/1983 | Clare et al. | 206/386 |
| 4,480,748 | 11/1984 | Wind | 206/386 |
| 4,558,784 | 12/1985 | Wallis | 206/561 |
| 4,921,101 | 5/1990 | Gatt | 206/596 |
| 5,052,307 | 10/1991 | Morrison . | |
| 5,205,410 | 4/1993 | Kuipers et al. | 206/386 |
| 5,421,455 | 6/1995 | Clatanoff et al. | 206/499 |
| 5,423,163 | 6/1995 | Wendt | 53/556 |
| 5,487,471 | 1/1996 | Marchek et al. | 206/386 |
| 5,531,327 | 7/1996 | Darby . | |
| 5,569,693 | 10/1996 | Doshi et al. | 524/317 |
| 5,694,836 | 12/1997 | Blevins | 206/386 |

FOREIGN PATENT DOCUMENTS

| | | |
|---|---|---|
| 52101 | 11/1966 | Germany . |
| 1252138 | 10/1967 | Germany . |
| 281 992 | 8/1990 | Germany . |

*Primary Examiner*—Jim Foster
*Attorney, Agent, or Firm*—Fish & Richardson P.C.

[57] ABSTRACT

A pallet system for supporting a load of at least one tray having side supports includes a pallet, having at least one pair of raised parallel guide rails on its top surface, each pair of guide rails configured to be straddled by side supports of a tray. The pallet may be loaded by sliding trays onto the pallet, and lateral movement of a tray loaded onto the pallet is limited by the pair of guide rails that it straddles.

28 Claims, 8 Drawing Sheets

PALLET SYSTEM

BACKGROUND

The invention relates to pallet systems, and in particular, pallet systems that facilitate loading and unloading, and limit the shifting of loaded items.

Pallets are used to ship loads of one or more items that are placed and secured onto pallets. Smaller items may be shipped by packaging the items into larger packaging units, which are then loaded onto the pallets. For example, to ship a large quantity of loose or fragile items such as eggs, the items may be arranged in stackable trays, and the stacked trays are loaded onto the pallet.

A pallet loaded with items is often wrapped for shipment to secure the load, sometimes using rigid end boards.

SUMMARY

In general, in one aspect, the invention features a pallet system for supporting a load of at least one tray having side supports. The pallet system includes a pallet having at least one pair of parallel guide rails raised above a top surface of the pallet, each pair of guide rails configured to be straddled by side supports of a tray.

Advantageous embodiments of the invention include one or more of the following features. The space between each pair of guide rails is substantially open. The guide rails are raised above the level of a weight bearing area of the top surface of the pallet.

The pallet system includes at least one end stop on the top surface of the pallet, each end stop positioned to limit longitudinal movement of a tray loaded on the pallet. The pallet system includes two end plates, configured to be vertically positioned at edges of the pallet at ends of the guide rails. Each end plate has an inside surface shaped to complement contours of the end surfaces of the tray. The pallet system includes end plate holders for securing the first and second end plates. In one example, the end plate holders are notches in the guide rails.

The pallet system includes a pallet base comprising a conventional pallet and a pallet cap securely fitting onto the pallet base to form the pallet, the top surface of the pallet cap forming the top surface of the pallet.

In general, in another aspect, the invention features a stacked pallet, including a pallet, having at least one pair of parallel guide rails raised above its top surface, and trays stacked in layers on the pallet, wherein each tray of the first layer has side supports straddling a pair of guide rails on the pallet.

Advantageous embodiments of the invention include one or more of the following features. The stacked pallet further includes end plates secured to the stacked trays. For example, wrapping secures the end plates to the stacked trays. Adjacent trays in the first layer of the stacked trays are laterally interlocked by the guide rails straddled by the adjacent trays. Within each layer of trays, the trays laterally interlock.

In general, in another aspect, the invention features a method of loading a pallet by providing at least one pair of raised parallel guide rails on a top surface of a pallet and forming a first layer of trays by sliding each tray onto the pallet along a pair of guide rails.

Advantageous embodiments of the invention include one or more of the following features. The method provides at least one end stop on the top surface of the pallet, wherein a tray is slid along a pair of guide rails until its front surface contacts an end stop.

The method forms a stack of trays by repeatedly sliding trays over trays already on the pallet. Trays of the stack are laterally interlocked. The method secures end plates to the stack of trays. When secured, an end plate has an inside surface facing an outside surface of the stack of trays. This inside surface is contoured to complement the outside surface of the stack of trays. Securing end plates to the stack of trays is achieved in one example by wrapping the end plates to the stack of trays.

Among the advantages of the invention are one or more of the following.

The pallet system restricts both the lateral and longitudinal movement of items loaded onto the pallet.

Vertically positioned end plates at both pallet edges at ends of the guide rails further restrict the longitudinal movement of items on the pallet. The pallet system provides enhanced stability when loaded and wrapped.

The pallet allows trays to be slid on and off, and is suitable for automated loading and unloading of the trays.

Other features and advantages of the invention will become apparent from the following description and from the claims.

DETAILED DESCRIPTION

Figure 1:
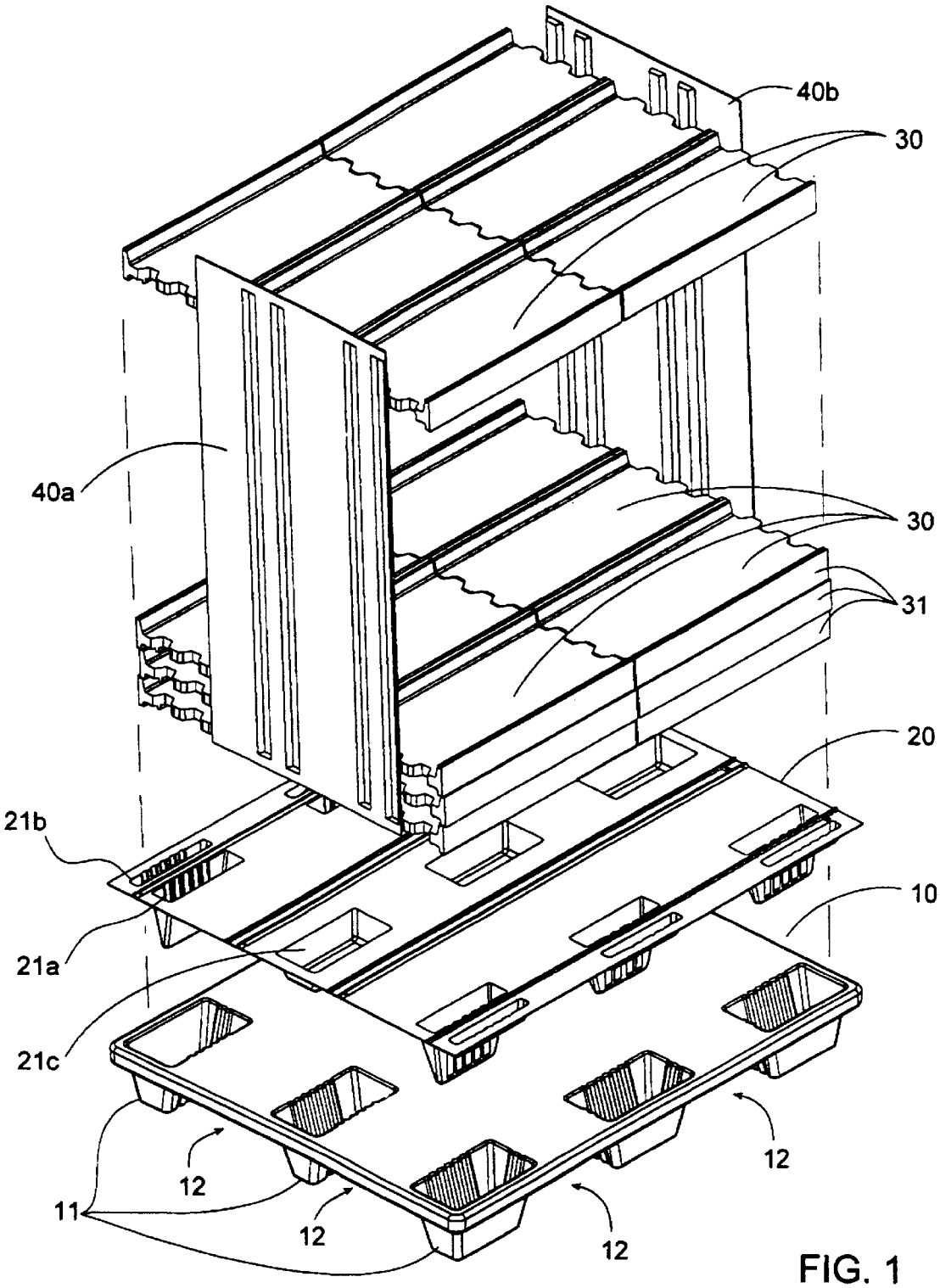
FIG. 1. is a perspective view of a pallet system in accordance with the invention.

Referring to FIG. 1, a pallet system based on a conventional pallet, referred to here as the pallet base 10, is fitted with a pallet cap 20 to provide a pallet in accordance with the invention. Alternatively, the pallet may be a single integrated unit. The pallet system can be used, for example, to ship trays 30 such as those described in pending U.S. Pat. No. 5,816,406, which is incorporated by reference.

FIG. 1 shows in an exploded view the relationship of elements of the pallet system. Several layers of trays are loaded onto the pallet, and the end plates 40*a*, 40*b* are respectively positioned at front and back ends of the load to help secure the load of trays 30 to each other and to the pallet, as well as to protect the ends of the trays and provide rigidity to the stack of trays. Typically, though not shown in FIG. 1, the entire load including the end plates 40*a*, 40*b* is wrapped with a film, either manually or using a machine and methods such as those described in U.S. Pat. Nos. 5,423,163 and 5,531,327.

The pallet base 10 is a conventional plastic pallet. As shown, a conventional plastic pallet typically has pockets 11 that elevate the top surface of the pallet and provide recesses 12 which allow the pallet to be handled by standard equipment such as forklifts. Because the exact shape and placement of the pallet pockets 11 may vary among pallet models and manufacturers, the pallet cap 20 has pockets 21*a*, 21*b*, 21*c* customized to fit within the pockets 11 of a particular pallet 10.

The pallet cap pockets 21*a*, 21*b*, 21*c* position the pallet cap 20 on the pallet base 10 and provide support for the weight of loads borne by the pallet cap 20. In the configurations shown in FIGS. 1 and 2, the pallet cap pocket 21*a* extends to the base of the pallet base pocket 11 to provide support and has ribbed walls to provide structural strength. Pallet cap pockets 21*b* and 21*c* are provided primarily for positioning the pallet cap 20 on the pallet base 10.

Figure 2:
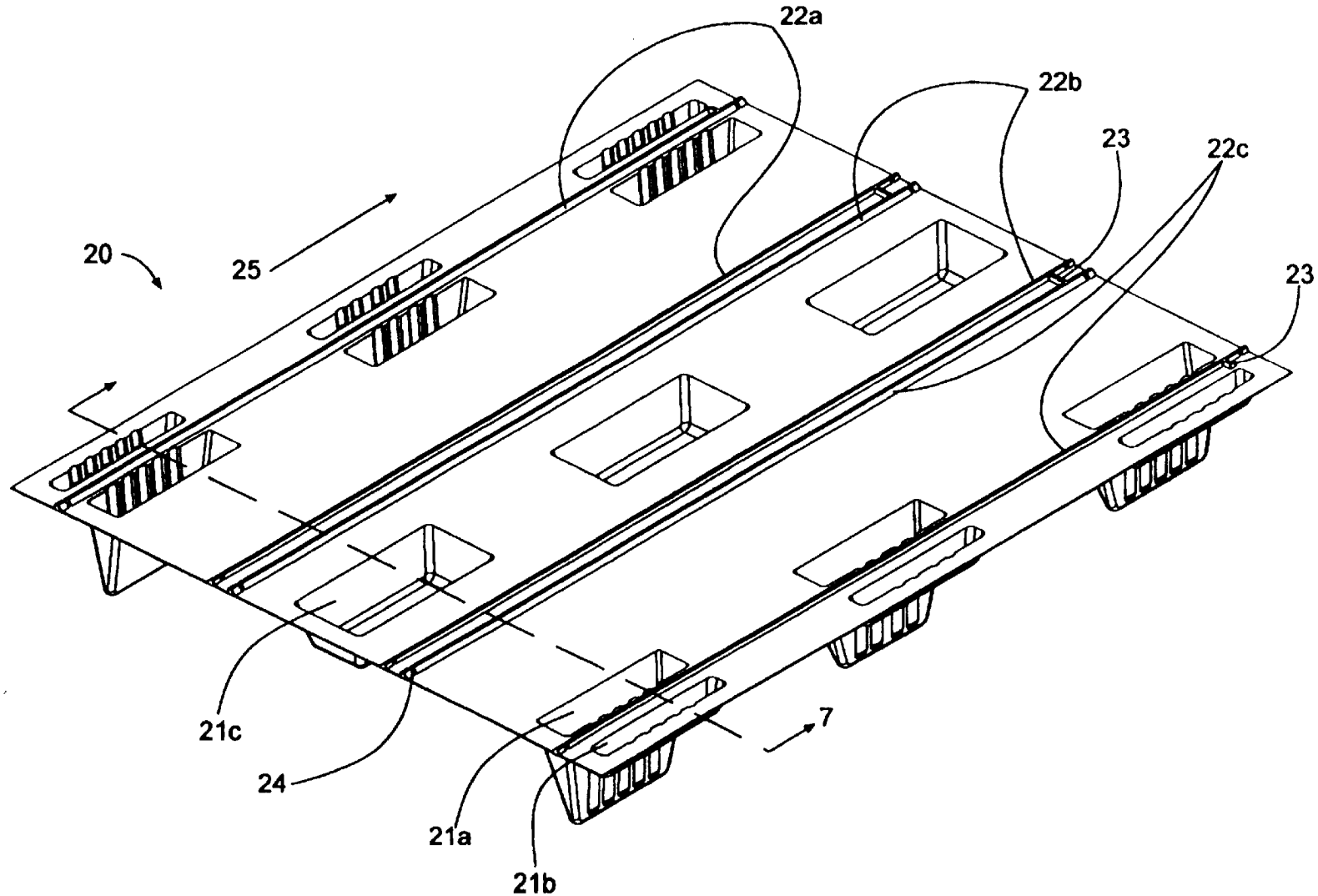
FIG. 2 is a perspective view of a pallet cap in accordance with the invention.

Referring to FIG. 2, the pallet cap 20 has raised, parallel guide rails 22, which are labelled in pairs 22*a*, 22*b*, 22*c*. The number of guide rails 22 may vary, depending on the size and shape of the trays to be loaded. For example, FIG. 2 shows a pallet cap 20 having three pairs of guide rails 22*a*, 22*b*, 22*c*, designed for a load three trays wide, as is illustrated in FIG. 1.

Figure 3:
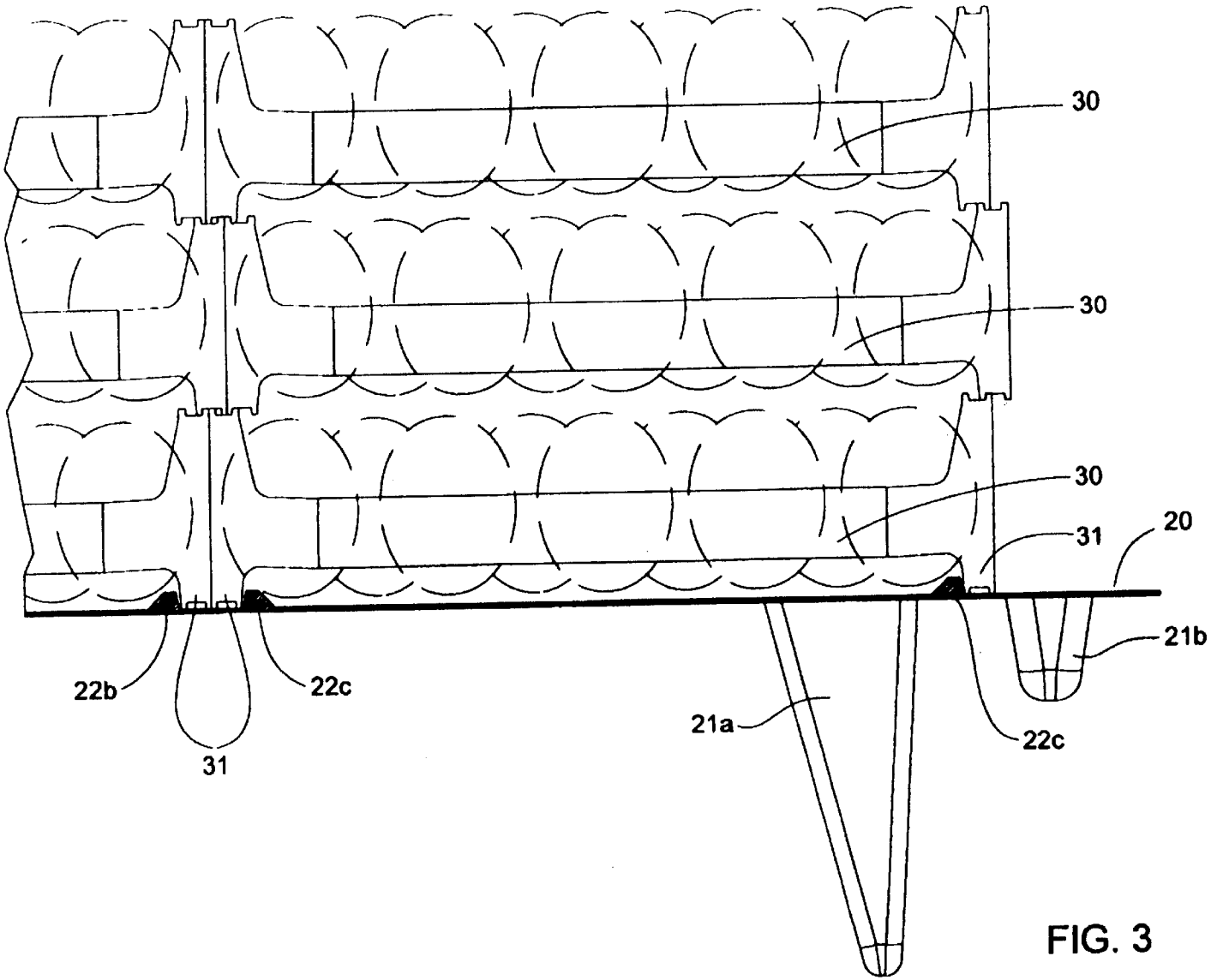
FIG. 3 is a cross-sectional view of a loaded pallet system in accordance with the invention.

Referring to FIG. 3, each tray 30 has side supports 31. The pairs of guide rails, such as pair 22*c*, are sized and spaced so that when such a tray is loaded directly on the pallet cap 20, the tray side supports 31 closely straddle a pair of guide rails, thus constraining the lateral movement of the tray 30. The guide rails 22*c* help to position the tray 30, and as shown, also help to interlock adjacent trays 30. In FIG. 3, the top surface of pallet cap 20 is substantially open between the pair of guide rails 22*c*, which enables the open space to be used for packing items, in this case, eggs. The guide rails 22*c* avoid contact with the tray 30 or its load, and are raised above the level of the weight bearing surface of the pallet cap 20.

Figure 4:
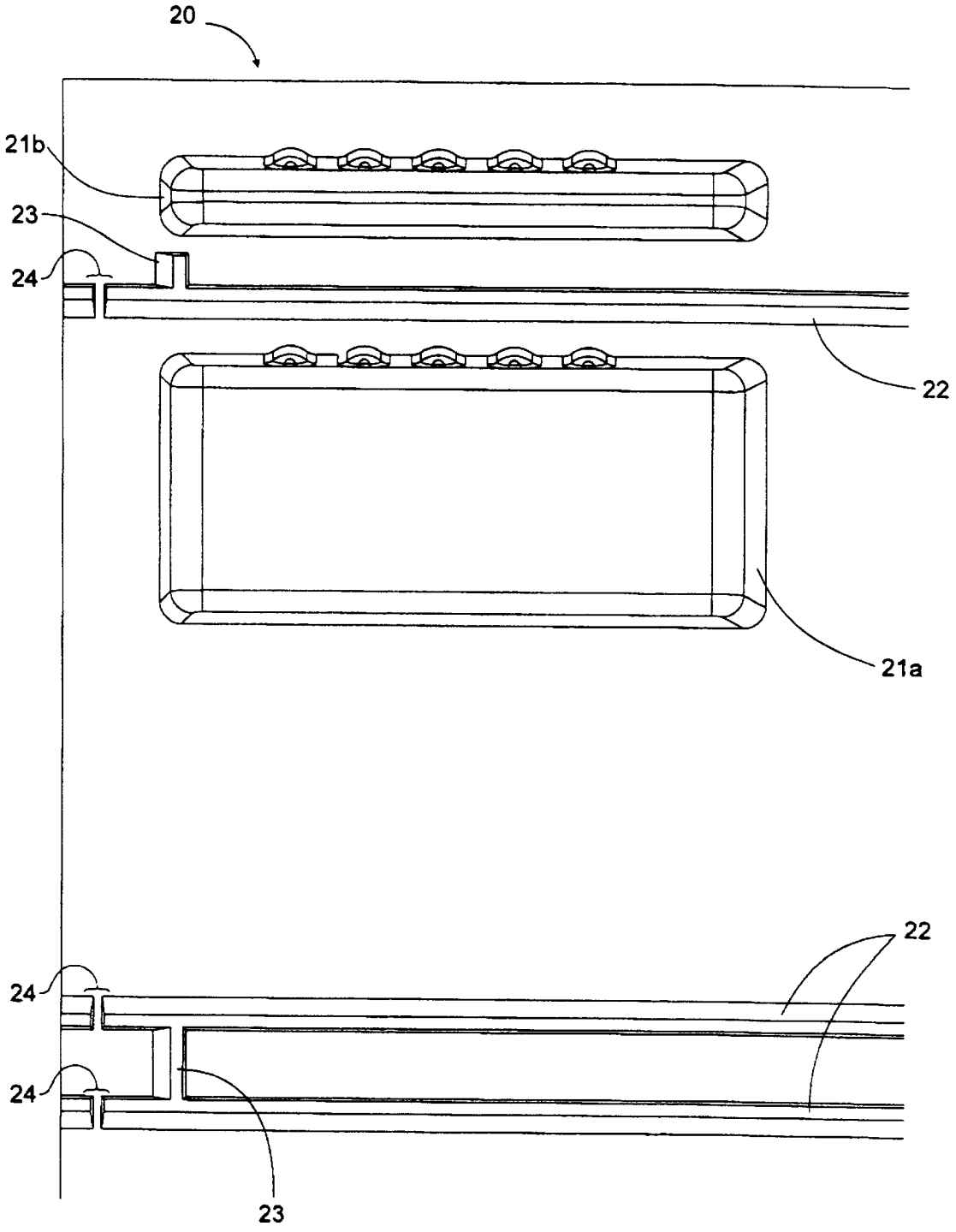
FIG. 4 is a top detail view of a pallet cap in accordance with the invention.

The arrangement of parallel guide rails allows trays to be loaded onto the pallet by sliding the tray over a pair of guide rails from a front end of the pallet towards a back end, along the direction of the arrow 25 of FIG. 2. The opposite action may be used to unload trays from the pallet. The motion of a tray may be stopped by optional end stops 23, which are positioned at the outer edges of each pair of guide rails 22, towards the back end of the pallet. These end stops 23 limit the longitudinal movement of the trays parallel to the guide rails 22. FIG. 4 provides a more detailed illustration of the positions of the end stops 23.

When a pallet is loaded and ready to be prepared for shipping, the end plates 40*a*, 40*b* are vertically positioned at the front and back ends of the pallet as shown in FIG. 1. End plates are vertically positioned in one or more of the notches 24 found at both ends of each guide rail 22 (FIGS. 2 and 4). The notches 24 act as end plate holders for holding the end plates in position.

Figure 5:
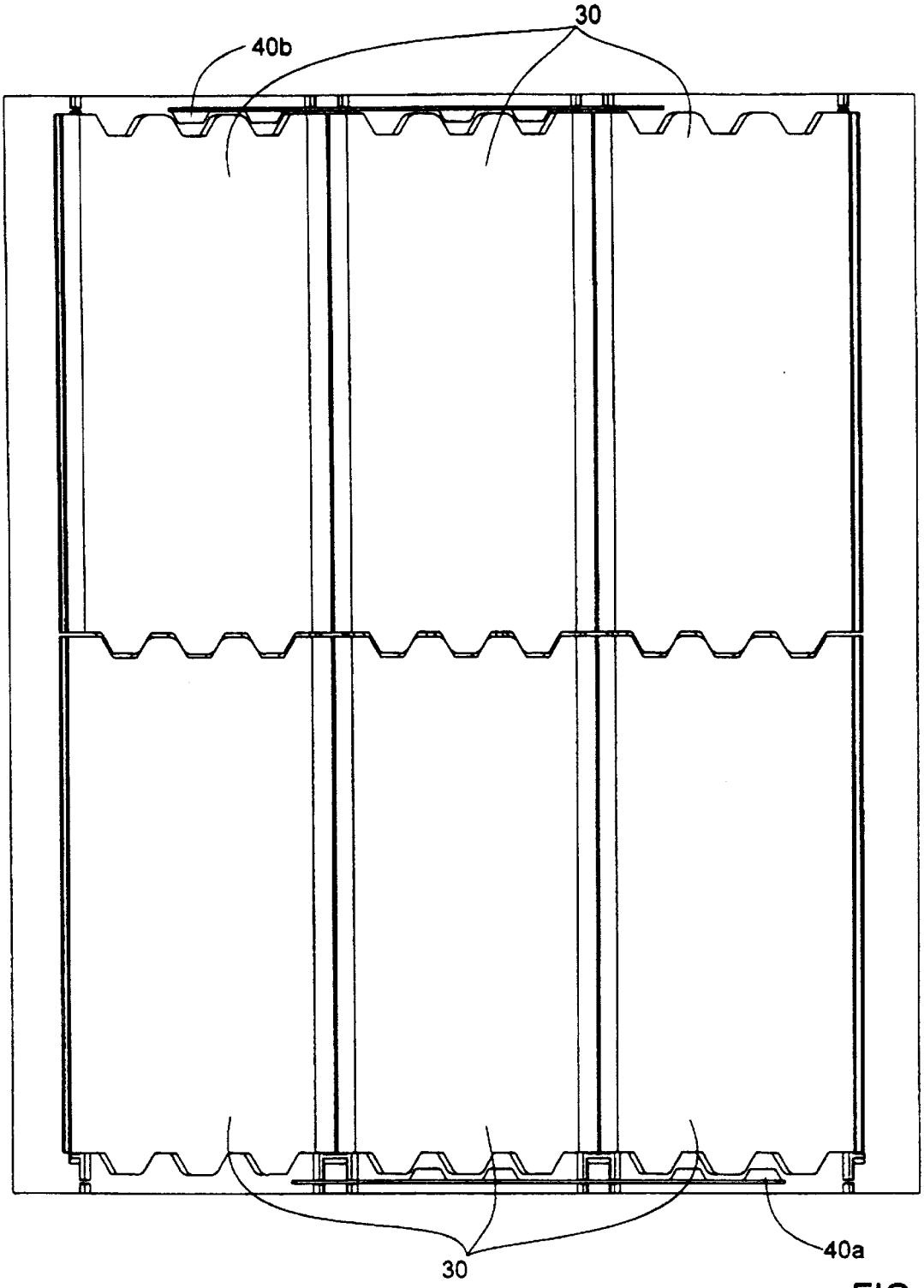
FIG. 5 is a top view of a loaded pallet in accordance with the invention.

End plates may provide greater stability to a stack of trays by being shaped to complement the shapes of the trays loaded onto the pallet. For example, FIG. 5 shows a top view of a pallet loaded with trays 30 shaped like those described in U.S. Ser. No. 08/673,698. The end plates 40*a*, 40*b* are shaped to complement the contour of the tray edges.

Figure 6:
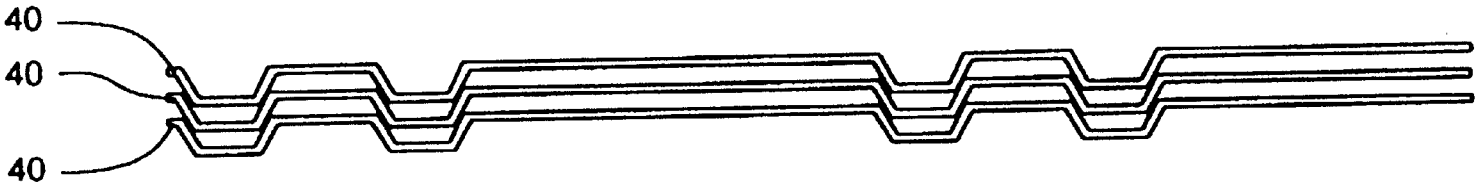
FIG. 6 is a cross-sectional view of a stack of end plates in accordance with the invention.

Referring to FIGS. 1 and 5, the end plates 40*a*, 40*b* at both ends of the pallet may be substantially identical or interchangeable. The end plates may be narrower than the pallet or load, as shown, and advantageously may be approximately 22 inches wide which allows them to be used with pallets and loads of different widths. For example, a pallet having an industry standard size of 40 inches by 48 inches can support layers having two rows of three trays, where the trays are egg trays of a standard size, such as is disclosed in U.S. Ser. No. 08/673,698. However, pallets of other sizes can be used, including 24 inches by 48 inches (supporting two rows of two trays) and 36 inches by 24 inches (supporting one row of three trays). The end plates 40*a*, 40*b* shown in FIGS. 1 and 5 may be used for pallets having any of these dimensions. FIG. 6 illustrates a cross-section of a stack of end plates 40. As shown, the end plates may be shaped such that they nest within one another, which saves space when they are not being used.

The components of the pallet system may be made of various materials. For example, the pallet cap and end plates may be comprised of a plastic such as polypropylene or ABS plastic.

Figure 7:
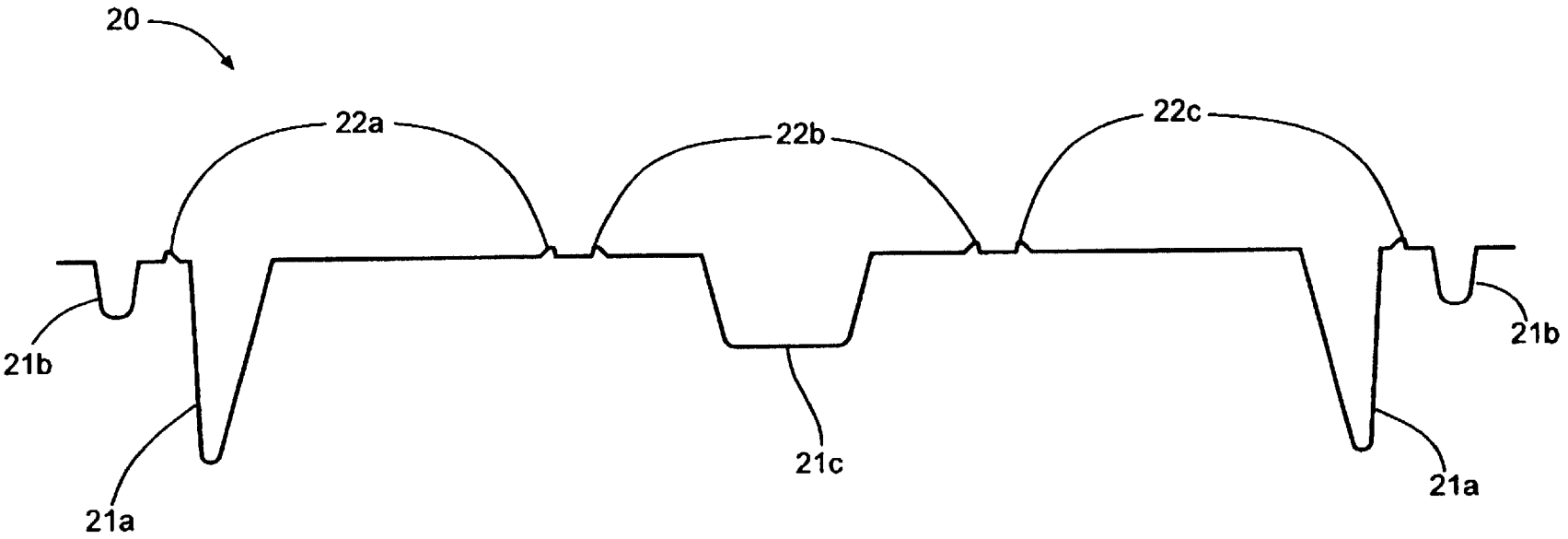
FIG. 7 is a cross-sectional view of the pallet cap of FIG. 2.

Each component can be manufactured by a variety of methods. For example, FIG. 7 illustrates a cross-section of the pallet cap 20 shown in FIG. 2, created from a sheet of plastic having a thickness approximately in the range of 0.08–0.125 inches. The plastic sheet can be formed by methods such as thermo forming, rotomolding, and injection molding. The same thickness and methods apply to the end plates as well.

Figure 8:
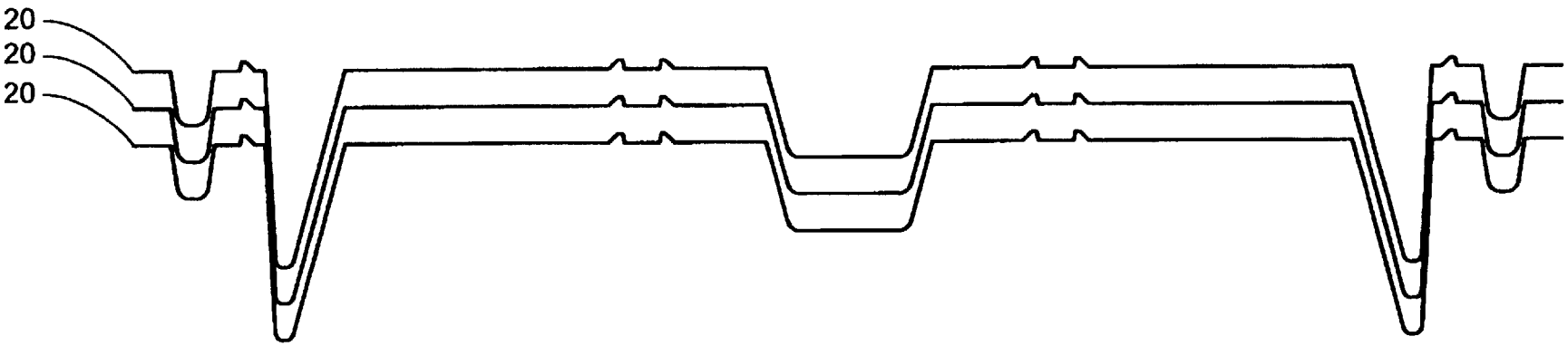
FIG. 8 is a cross-sectional view of a stack of pallet caps in accordance with the invention.

Various features of the pallet system may be customized for its intended load. For example, the pallet system exemplified in the figures is customized for supporting egg trays described in U.S. Ser. No. 08/673,698. As shown in FIG. 3, because the trays 30 carry eggs, which are fragile and have rounded bottoms, the side of the guide rails 22 likely to contact the portion of the tray 30 holding an egg have a slanted edge. At their widest point, the guide rails 22 have a width of approximately 0.5 inches, and at their highest point, have a height of approximately 0.25 inches. As shown, the guide rails 22 do not support the weight of the trays and their load. Because the trays 30 are designed to be slid into place on the pallet, end stops 23 are provided at only one end of the guide rails 22, as shown in FIG. 2. Because the trays 30 have honeycomb-shaped edges, the inside surface of the end plate is shaped to complement this surface, as shown in FIG. 5. The raised portions of the end plate have a height of approximately 0.5 inches and a width of approximately 1 inch. As shown in FIG. 6, the end plates 40 are shaped such that they are interchangeable and nest within one another, which saves space when they are not being used. FIG. 8 illustrates that the pallet cap 20 is also shaped to allow several pallet caps to be nested within one another.

Other embodiments are within the scope of the following claims. For example, the pallet may be a single integrated unit rather than a pallet cap fitting onto a conventional pallet. The sizes and positions of pallet cap pockets may vary. The length and height of guide rails, as well as the number of guide rails on a pallet may vary. The shapes and positions of the end stops may vary. For example, end stops may be implemented as a continuous rail across the pallet surface. End stops may be provided at both ends of the pallet if trays are not slid onto the pallet. End plates may have a different width, such as the full width of a pallet.

What is claimed is:

1. A pallet system for supporting a load of at least one tray having side supports, comprising:

a pallet having a top surface and at least first and second pairs of parallel guide rails raised above the top surface of the pallet, the top surface comprising an exposed substantially planar region defined between the guide rails of each pair of guide rails, each pair of guide rails being configured to be straddled by side supports of a tray to be supported and to allow tray side supports in contact with the guide rails to slide freely along the guide rails, the top surface further comprising a sliding area for supporting the tray side supports and comprising a planar region defined between the first and second pair of guide rails and extending unobstructed substantially from one edge of the pallet to another edge of the pallet, wherein the exposed substantially planar region is substantially greater in area than the sliding area, and at least one edge of the pallet is not raised above the sliding area of the top surface.

2. The pallet system of claim 1, wherein each guide rail has an inner edge and an outer edge, both edges extending upward from the top surface of the pallet on opposite sides of each guide rail, and the exposed substantially planar region lies between the facing inner edges of each pair of guide rails.

3. The pallet system of claim 2, wherein each guide rail has a slanted inner edge and is wider at the top surface of the pallet than at the top of the guide rail.

4. The pallet system of claim 3, wherein the load to be supported by the pallet system includes an egg tray having approximate dimensions of 12 inches by 24 inches.

5. The pallet system of claim 2, wherein the load to be supported by the pallet system includes egg trays, the pallet system further comprising a first and a second end plate, configured to be vertically positioned at edges of the pallet at ends of the guide rails.

6. The pallet system of claim 2, wherein the guide rails have a width of approximately 0.5 inches at their widest point and a height of approximately 0.25 inches at their highest point.

7. The pallet system of claim 6, wherein the tray to be supported on the pallet has approximate dimensions of 12 inches by 24 inches.

8. The pallet system of claim 1, wherein the pair of guide rails is raised above the top surface of the pallet and the guide rails are sized and arranged so that the guide rails do not contact the bottom surface of a tray supported by side supports loaded onto the pallet.

9. The pallet system of claim 8, further comprising at least one end stop on the top surface of the pallet, each end stop positioned at the outer edges of each pair of guide rails towards a back end of the pallet to stop any sliding of a tray loaded on the pallet at the corresponding edge of the pallet.

10. The pallet system of claim 1, further comprising a first and a second end plate, configured to be vertically positioned at edges of the pallet at ends of the guide rails.

11. The pallet system of claim 1, further comprising a first end plate and a second end plate each configured to be vertically positioned at edges of the pallet at ends of the guide rails, wherein the tray to be supported on the pallet has a honeycomb-shaped end surface facing an inside surface of an end plate, and the inside surface of the end plate is shaped to complement the honeycomb-shaped end surface of the tray.

12. The pallet system of claim 10, wherein the first and second end plates are substantially identical.

13. The pallet system of claim 1, wherein the pallet has end plate holders for securing the first and second end plates.

14. The pallet system of claim 13, wherein the end plate holders are notches in the guide rails.

15. The pallet system of claim 1, wherein the pallet further comprises:

a pallet base comprising a conventional pallet; and a pallet cap securely fitting onto the pallet base to form the pallet and having a top surface forming the top surface of the pallet.

16. The pallet system of claim 1, wherein the pallet has approximate dimensions selected from the group consisting of 40 inches by 48 inches, 24 inches by 48 inches, and 36 inches by 24 inches.

17. The pallet system of claim 10 in combination with the tray, the tray being loaded on the pallet and having a honeycomb-shaped end surface facing an inside surface of an end plate, the inside surface of the end plate being shaped to complement the honeycomb-shaped end surface of the tray.

18. The pallet system of claim 1, wherein the unobstructed sliding area extends to at least one edge of the pallet so that the tray to be supported can be slid into place by sliding side supports of each tray along a pair of guide rails from a front end of the pallet towards a back end without lifting the tray above the level of the top surface of the pallet.

19. The pallet system of claim 9, wherein the unobstructed sliding area extends to an edge of the pallet opposite the stop, so that the tray to be supported can be slid into place by sliding side supports of each tray along a pair of guide rails from a front end of the pallet to wards a back end without lifting t he tray above the level of the top surface of the pallet.

20. The pallet system of claim 1, wherein the guide rails of each pair of guide rails are sized and spaced so that when a tray is loaded directly on the pallet, the guide rails help to position the tray and interlock adjacent trays.

21. The pallet system of claim 1, further comprising at least one end stop on the top surface of the pallet, each end stop positioned at the outer edges of each pair of guide rails towards the back end of the pallet to stop any sliding of a tray loaded on the pallet at the corresponding edge of the pallet.

22. A stacked pallet, comprising:

a pallet having a top surface and at least one pair of parallel guide rails raised above the top surface of the pallet; and trays stacked in layers on the pallet, wherein each tray of a first layer has side supports straddling one pair of said guide rails on the pallet and resting on a sliding area on the top surface of the pallet, the sliding area extending unobstructed substantially from one end of the pallet to another end of the pallet, along outside edges of the pair of guide rails.

23. The stacked pallet of claim 22, further comprising a first and a second end plate, both secured to the stacked trays.

24. The stacked pallet of claim 23, further comprising wrapping that secures the first and the second end plates to the stacked trays.

25. The stacked pallet of claim 22, wherein adjacent trays in a first layer of the stacked trays are laterally interlocked by the guide rails straddled by the adjacent trays.

26. The stacked pallet of claim 22, wherein each layer of trays comprises laterally interlocked trays.

27. The stacked pallet of claim 22, wherein the top surface has a sliding area for the side supports of a tray along respective opposite-facing outside edges of the guide rails, the sliding area extending unobstructed from one edge of the pallet substantially to the opposite edge of the pallet.

28. The stacked pallet of claim 22, wherein the top surface comprises an exposed substantially planar region between each pair of guide rails, the exposed substantially planar region is substantially greater than the sliding area.

* * * * *